United States Patent [19]

Henne

[11] Patent Number: 5,072,974

[45] Date of Patent: Dec. 17, 1991

[54] PUSH TO CLOSE LATCH FOR SELF-CLEANING OVEN

[75] Inventor: John R. Henne, Burlington, Conn.

[73] Assignee: The Stanley Works, New Britain, Conn.

[21] Appl. No.: 652,123

[22] Filed: Feb. 7, 1991

[51] Int. Cl.[5] ..... E05B 47/00

[52] U.S. Cl. ..... 292/126; 292/201; 292/DIG. 4; 292/DIG. 62; 292/DIG. 69

[58] Field of Search ..... 292/126, 127, 144, 201, 292/254, 336.3, DIG. 4, DIG. 62, DIG. 69

[56] References Cited

U.S. PATENT DOCUMENTS

| | | | |
|---|---|---|---|
| 3,099,471 | 7/1963 | Scott et al. | 292/7 |
| 3,387,874 | 6/1968 | Holtkamp | 292/201 |
| 3,406,677 | 10/1968 | Anderson | 126/197 |
| 3,416,515 | 12/1968 | Mertler | 126/273 |
| 3,469,568 | 9/1969 | Torrey et al. | 126/39 |
| 3,521,618 | 7/1970 | Smith et al. | 126/197 |
| 3,757,084 | 9/1973 | McLean et al. | 219/413 |
| 3,815,942 | 6/1974 | White | 292/113 |
| 3,823,294 | 7/1974 | Takayama et al. | 219/10.55 |
| 3,859,979 | 1/1975 | Gilliom | 126/197 |
| 3,894,214 | 7/1975 | Staples | 219/394 |
| 4,088,354 | 5/1978 | Kolendowicz | 292/201 |
| 4,109,637 | 8/1978 | Drouin | 126/197 |
| 4,133,337 | 1/1979 | Shea | 126/197 |
| 4,340,806 | 7/1982 | Bergquist | 219/413 |
| 4,345,144 | 8/1982 | Bergquist | 219/413 |
| 4,374,320 | 2/1983 | Barnett | 219/413 |
| 4,482,175 | 11/1984 | Sugie | 292/45 |
| 4,593,945 | 6/1986 | Arute et al. | 292/201 |
| 4,623,179 | 11/1986 | Davis et al. | 292/201 |
| 4,932,707 | 6/1990 | Ekstran | 292/341.17 |
| 5,004,276 | 4/1991 | Hanley | 292/126 |

*Primary Examiner*—Richard E. Moore

[57] ABSTRACT

An oven door latching system has a latch bolt with a latch arm at one end and its other end pivotably connected to a lever through a resilient connection. The lever in turn is pivotably coupled to a positioning device which has a positioning element which is reciprocatable between spaced positions. When the positioning element is moved, pivotal motion is imparted to the other end of the lever, and the connection enables pivotal motion of the latch bolt. A solenoid acts on the positioning device to move the positioning element between its stable positions and produces concurrent motion of the lever to enable movement of the bolt between an oven door latching position and an oven door unlatching position.

11 Claims, 6 Drawing Sheets

PUSH TO CLOSE LATCH FOR SELF-CLEANING OVEN

BACKGROUND OF THE INVENTION

The present invention relates to latches for stoves and like appliances, and more particularly to a latch assembly for use in self-cleaning ovens.

In self-cleaning ovens, it is essential that the oven door be latched against inadvertent opening during such period of time as the oven is at a high temperature. Various types of manual devices have been proposed for this application, and it is now customary to include some form of thermostatically controlled mechanism to prevent inadvertent opening of the door or opening of the door by a child. Some latch assemblies include a projecting lever which extends outwardly of the door or of the stove frame to effect initial engagement, and users of the appliances sometimes inadvertently strike such levers.

It is an object of the present invention to provide a novel oven latch which may be engaged and disengaged by pushing the oven door inwardly against the latch bolt.

It is also an object to provide such a latch assembly in which the latch bolt is securely retained in latched position during the high temperature cleaning cycle.

Another object is to provide such a latch which may be fabricated readily and relatively economically, and which will exhibit long lived operation.

A further object is to provide such a latch assembly in which a solenoid is employed in the latching assembly for positioning the latch bolt.

SUMMARY OF THE INVENTION

It has now been found that the foregoing and related objects may be readily attained in an oven door latching system for use with a stove having an oven which includes a latch assembly with a base member adapted to be mounted on the stove adjacent the oven opening. A latch bolt has one end pivotally mounted on a pivot pin on the base member and a latch arm at the other end engageable with the associated oven door.

A positioning device is mounted on the base member and comprises a guide and a positioning element reciprocatable therein between first and second positions. A preferred positioning element used in the assembly of the present invention is disclosed and claimed in copending application Ser. No. 07/468,255 filed on Jan. 22, 1990 by Roger T. Hanley, now U.S. Pat. No. 5,004,276 granted Apr. 2, 1991.

A lever has one end pivotally coupled to the one end of the positioning element, and it is also pivotally mounted on the pivot pin at a point spaced from its end mounted on the slide. Suitable means connects the latch bolt and the lever adjacent the pivot pin whereby, when the positioning element is moved, pivotal motion is imparted to the lever, and the connecting means enables pivotal motion of the latch bolt.

Actuatable means is provided for acting on the positioning element to move it from its first position to its second position. This movement produces concurrent motion of the lever, which permits movement of the bolt between an oven door latching position and an oven door unlatching position.

Preferably, the connecting means includes resiliently deformable means to bias the latch bolt into its two positions. Desirably, the latch bolt and lever have projecting portions thereon which are spaced apart, and the resiliently deformable means comprises a spring engaged with these projecting portions.

Most usually, the actuatable means is a solenoid actuated by setting of the associated oven into a self-cleaning condition.

The latch assembly is used in a stove having a frame defining an oven chamber with an opening thereinto, and a door having one edge pivotably mounted on the frame at one side of the chamber opening for movement between a closed position sealing the oven chamber and an open position. The latch assembly has its base member mounted on the frame at the side of the opening opposite that along which the door is pivotably mounted, and the latch bolt extends outwardly of the frame and is engageable with the oven door.

The solenoid is actuated by setting of the associated oven into a self-cleaning condition, conveniently by a switch moveable into a position to actuate a self-cleaning cycle, and actuation of the solenoid moves the positioning slide and thereby the latch bolt into a door latching position.

DETAILED DESCRIPTION OF PREFERRED EMBODIMENT OF THE INVENTION

Figure 10:
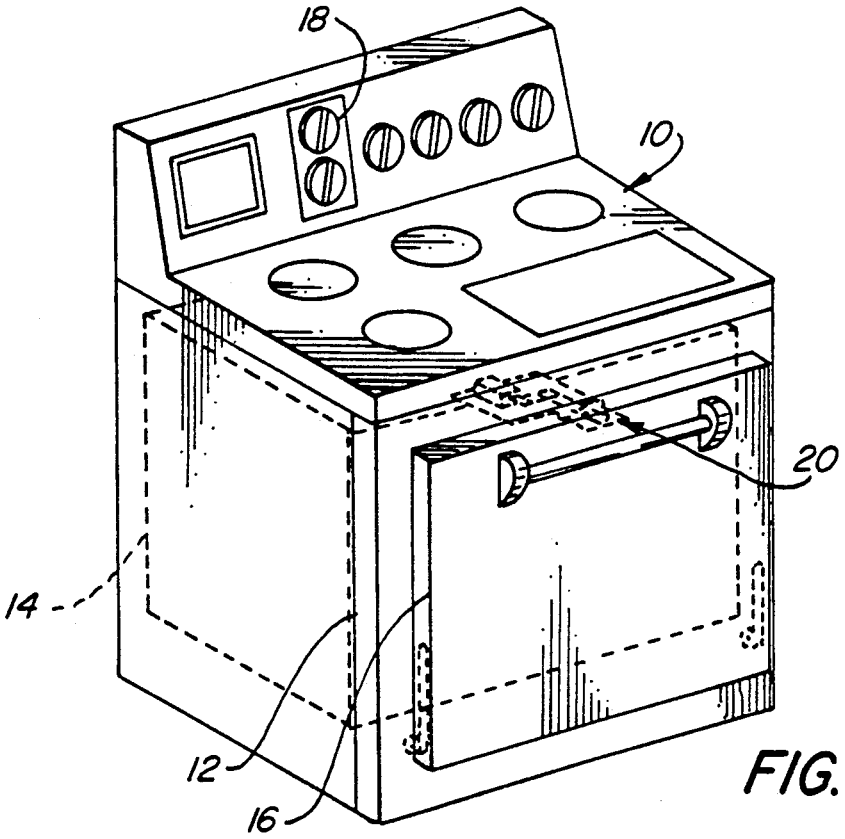
FIG. 10 is a perspective view of a stove employing the latch of the present invention.

Turning first to FIG. 10 of the drawings, therein illustrated is a stove generally designated by the numeral 10, a frame 12 providing an oven chamber 14 with an opening thereinto and a door 16 pivotably mounted on the frame 12 by hinges (not shown) for pivoting about an axis extending across the lower end of the oven door 16. The stove 10 has a switch 18 which provides a setting for actuating heating elements (not shown) about the oven chamber 14 to effect self-cleaning.

Figure 1:
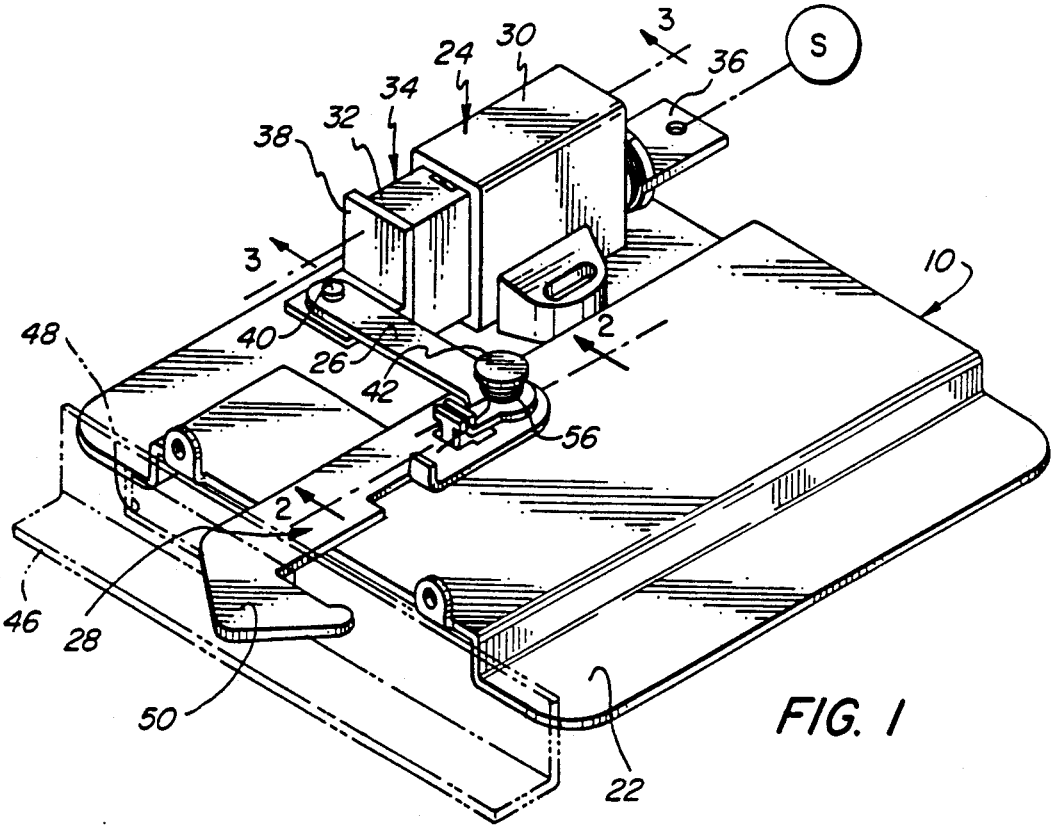
FIG. 1 is a perspective view of a latch embodying the invention shown as engaged with a keeper illustrated in phantom line.

Mounted on the frame 2 at the top of the oven chamber 3 is a latch embodying the present invention and generally designated by the numeral 20. As seen in FIG. 1, the latch 20 has a base plate 22 mounted on the frame 12, (not shown in FIG. 1) a positioning device generally designated by the numeral 24 which acts upon the lever 26, and a latch bolt 28 which is movable upon action of the lever 26.

The positioning device 24 preferably used in the latch of the present invention has heretofore been described and claimed in the previously identified copending application. It is pivotably mounted on the pivot pin 42 on the base plate 11, upon which is also pivotably mounted the inner end of the latch bolt 44.

Also seen in FIG. 1 is the keeper 46 of the oven door 16 which has an opening 48 through which the free or outer end of the latch bolt 44 extends and the latch nose 50 engages therebehind.

Figure 2:
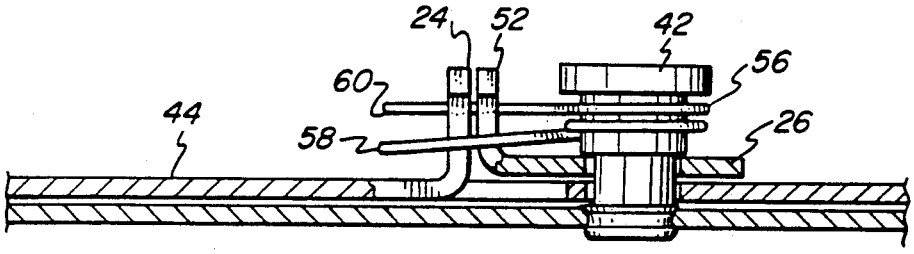
FIG. 2 is a sectional view along the line 2—2 of FIG. 1 and drawn to an enlarged scale.

As best seen in FIG. 2, the lever 26 and latch bolt 44 have upstanding T-shaped arms 52 and 54 respectively which are spaced relatively closely, and a torsion spring 56 is disposed below the head of the pin 42 above the lever 26 (and latch bolt 44). The ends 58 and 60 of the spring 56 bear upon the arms 52 and 54 and provide a resilient engagement therebetween.

Figure 3:
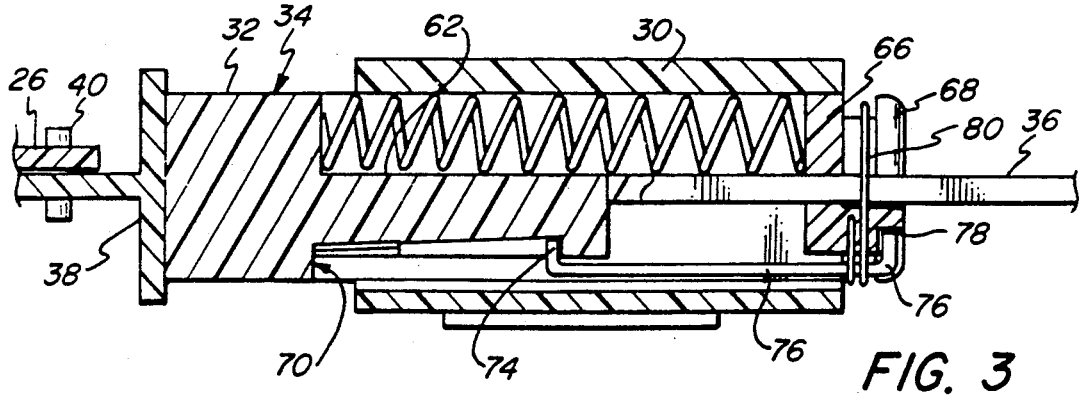
FIG. 3 is a fragmentary sectional view along the line 3—3 of FIG. 1 and drawn to an enlarged scale.

Turning now to FIG. 3, it can be seen that there is a recess 62 in the top surface of the body portion 32 of the slide 34. The coiled compression spring 64 is seated in the recess 62 and extends over the leg 36 and acts between the forward end of the recess 62 and the wall 66 of the end cap 68 to bias the slide 34 to the left as seen in FIG. 3.

As also seen in FIG. 2, the body portion 32 of the slide 34 has in its lower surface a cam recess generally designated by the numeral 70 in which is slidably seated the upstanding arm 72 at the forward or free end of the cam follower generally designated by the numeral 74. The opposite end of the cam follower 74 has an upstanding arm 76 which seats in a recess 78 in the end cap 68. A spring 80 extends about the end cap 68 and cam follower 74 to secure them in assembly while permitting limited pivotal motion of the cam follower 74 relative thereto, and it also provides upward biasing of the arm 72 into the cam recess 70.

Figure 4:
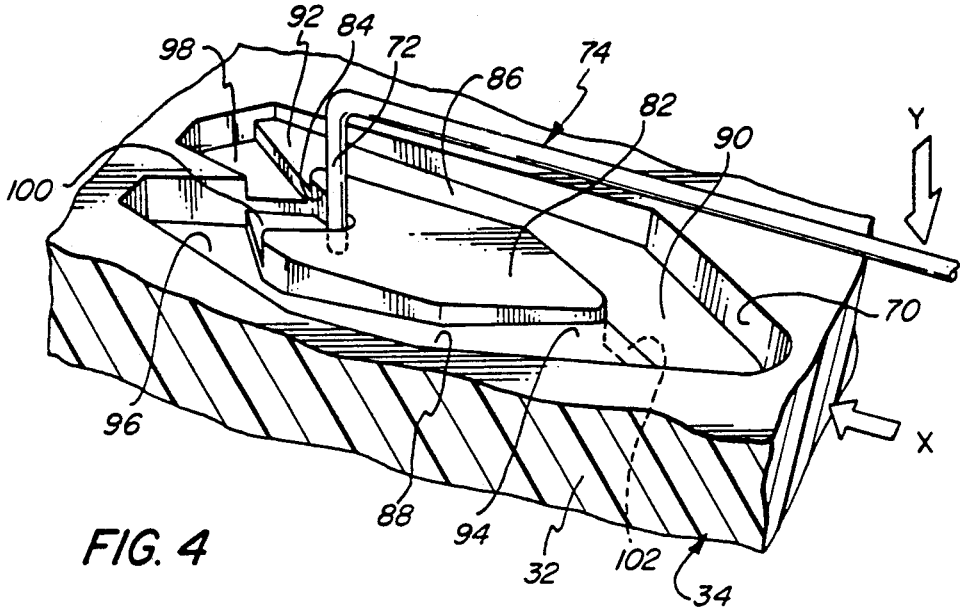
FIG. 4 is a fragmentary perspective view of the slide and follower components invented from the position seen in FIG. 3.

Turning now to FIG. 4, the slide 34 has been invented to illustrate more clearly the contours of the cam recess 70. The arrow X indicates the forward biasing pressure on the slide 34 provided by the spring 64, and the arrow Y indicates the upward biasing pressure on the cam follower 74 provided by the spring 80.

At the center of the cam recess 78 is an elevated land 82 having a generally V-shaped notch 84 at its forward end. Extending along the one side of the recess 78 is an inclined ramp surface 86 which tapers downwardly from left to right as seen in FIG. 4 (from the forward end toward the rearward end of the slide body 32) to provide a greater depth at the rearward end of the recess 78. Extending along the other side of the recess 78 is another inclined ramp surface 88 which tapers upwardly from the left to the right as seen in FIG. 4 (from the forward end toward the rearward end of the slide body 32) to provide a lesser depth at the rear of the recess 78. The area 90 thus represents the lowest point at the rearward end of the recess 78, and the area 92 represents the lowest part of the forward end. The area 94 represents the highest part at the rearward end, and the area 96, the highest point at the forward end.

At the forward end of the body portion 32, the level of the ramp surface 88 is substantially below that of the ramp surface 86, and a pair of steps 98 and 100 are disposed therebetween. As seen in FIG. 4, the step 78 is higher than the step 100 and is forwardly thereof. The step 100 is disposed in the area of the notch 84 in the land 82. At the rearward end of the cam recess 78, there is a shoulder 102 between the lower ramp surface area 90 and the ramp surface area 94. The vertical side surfaces of the land 82, the sidewalls of the recess 78, and the side faces of the ramp surfaces 86 88 and steps 98, 100 provide guide surfaces for the arm 72 of the cam follower 74, as will be described hereinafter.

The follower arm 72 is movable relative to the slide 34 between two stable positions in the cam recess 76. One position is in the low area 90 at the rearward end of the recess 76 where it is seated between the shoulder 102 of the ramp surface 88 and the peripheral wall of the recess 76. The other position is in the V-shaped notch 84 at the forward end of the land 82. In either position, the arm 72 tends to hold the slide 34 in a stable position relative to the housing 30.

Upon movement of the slide 34 in the direction of the arrow X, the follower 74 pivots about its rearward end and the arm 72 is biased along the left leg of the notch 84 on the step 100 until it drops onto the ramp 88 and travels rearwardly and upwardly along the wall of the land 82 until it falls off the ramp 88 into the stable area 90.

When the slide 34 is moved in the opposite direction, the arm 76 moves upwardly and forwardly along the ramp 86 along the wall of the land 82 until it faces onto the step 98, from which it falls onto the step 100 and slides into the notch 84.

The actual motion of the arm 72 is essentially arcuate by nature of the pivoting about the rearward end of the follower 74.

Figure 7:
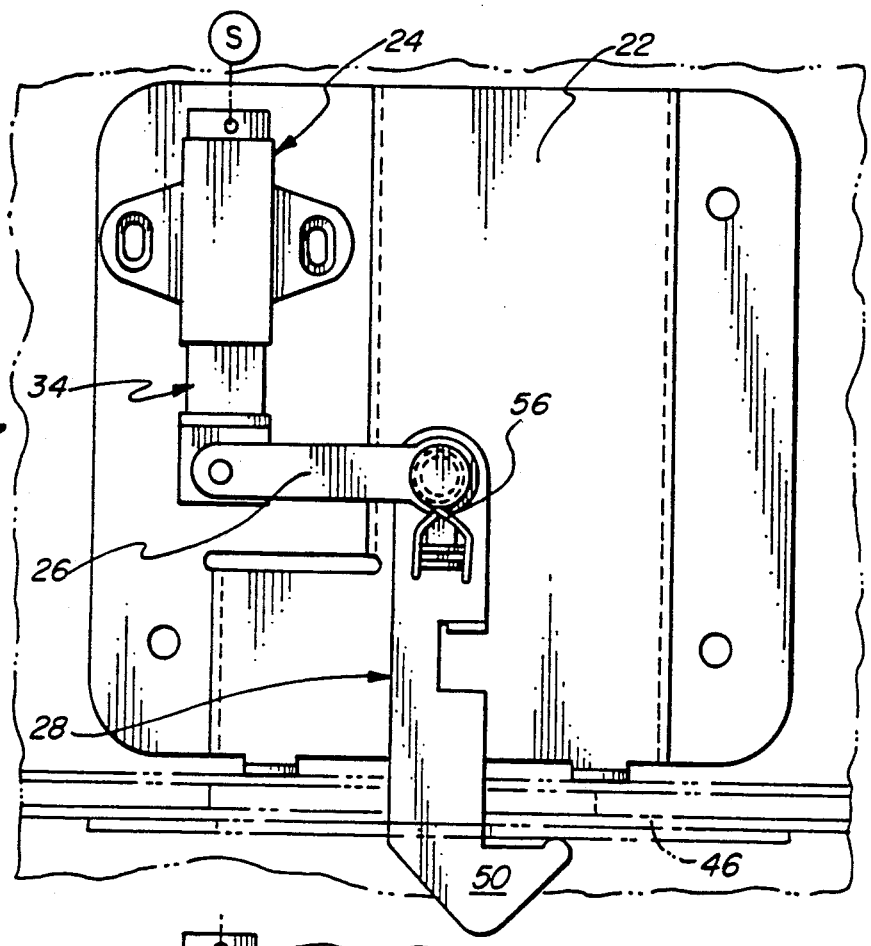
FIGS. 7, 8 and 9 are plan views of the latch of FIG. 1 in different positions of operation also showing parts of the keeper in phantom line.
Figure 8:
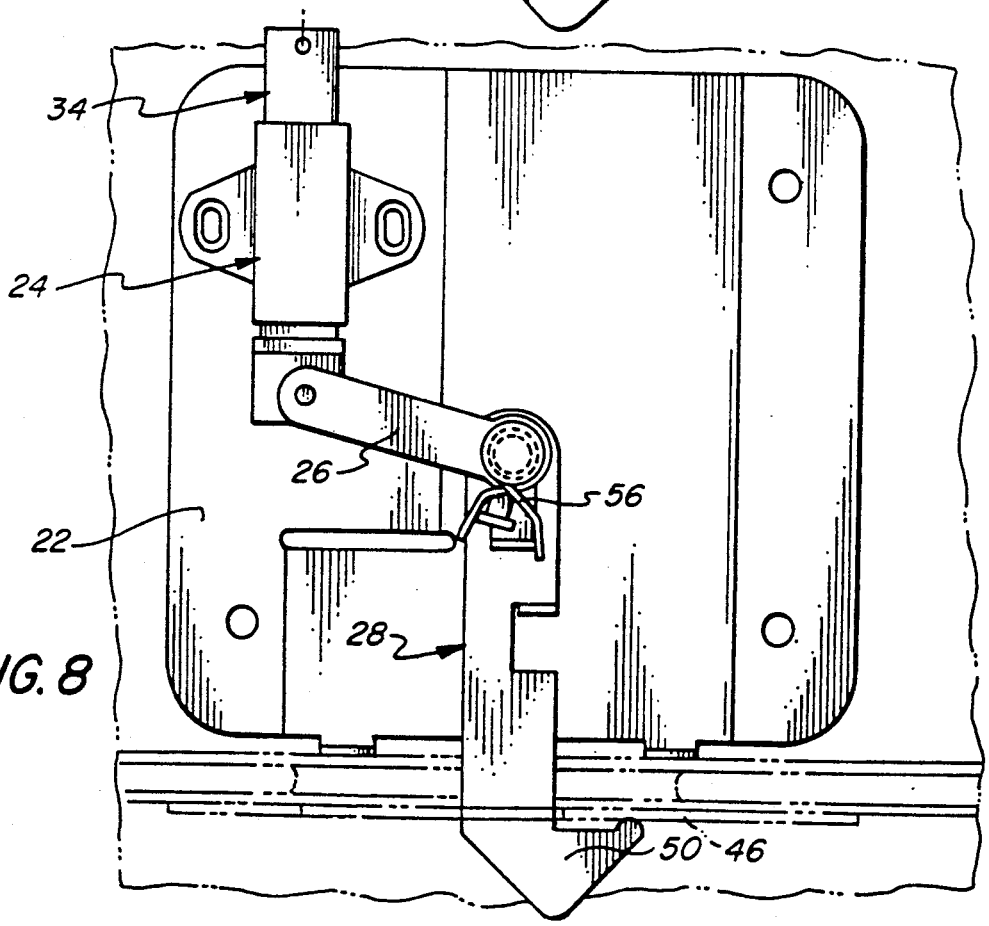
Figure 9:
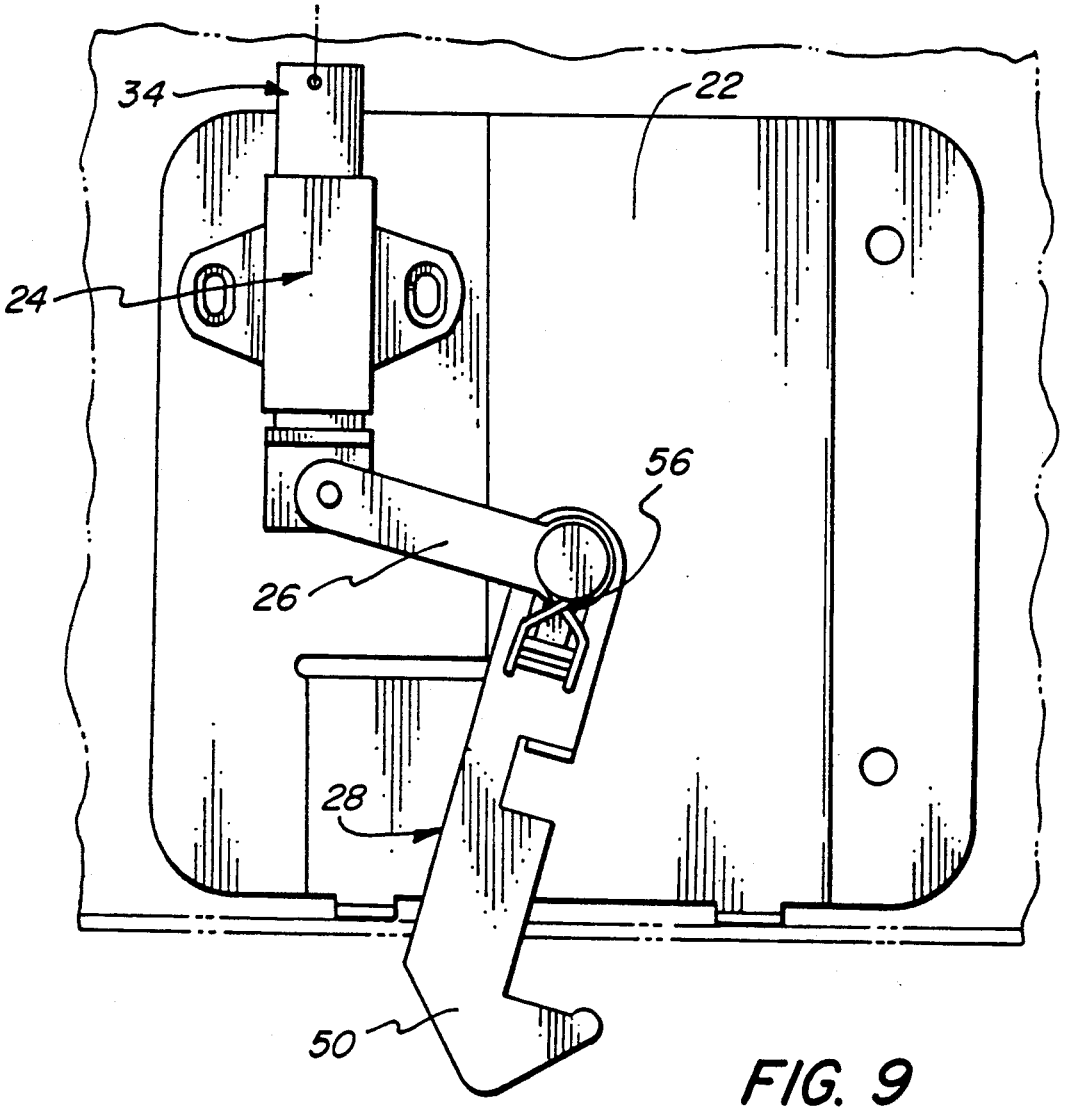

FIG. 7 shows the clamp assembly in a door locking position with slide body 32 extending outwardly of the housing 30. FIG. 8 shows the clamp assembly in a position with the slide body portion 32 retracted, and the bolt 44 pivoted to a position where the oven door may be opened by exerting pressure thereon. FIG. 9 shows the latch bolt 44 moved to an unlatching position.

Figure 5:
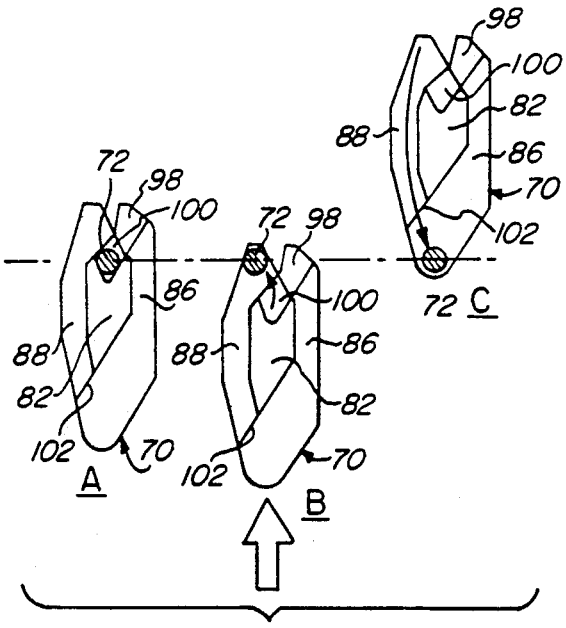
FIGS. 5 and 6 are diagrammatic views showing the operation of the pin and follower components of FIG. 4.

Referring now to FIG. 5, the relative motion of the arm in the cam recess 70 to effect locking is shown. In position A, the latch bolt 28 and lever 26 are in the position seen in FIG. 9. The arm 72 of the follower 74 is received in the notch 84 of the land 82. In this position, the oven door may be opened during a baking or a broiling operation, or may be opened by the user with no baking or broiling elements energized. If the solenoid S is pulsed to move the latch bolt 28 to the position shown in FIG. 7, the slide body 32 moves inwardly of the housing 30, and the arm 72 of follower 74 drops off of the step 100 onto the area 96 of ramp 88 (position B). The spring 64 biases slide 34 outwardly of housing 30, and the arm 72 of follower 74 moves along the ramp 88 to position C. At this point, the slide body 32 is moved outwardly of housing 30 and the latch bolt 28 is in the position shown in FIG. 7 with the latch nose 44 engaging the backing plate or keeper 46 on the inside panel 104 of the oven door 16.

As also seen in FIG. 7, the plate 46 and panel 104 have a slot 48 therein in which the latch bolt 28 pivotably moves. A resilient seal 106 is disposed between door inside panel 104 and the front of the stove 10.

After the self-cleaning cycle has been completed, and the interior oven temperature has dropped below a predetermined value, for example 600° F., the solenoid S may be pulsed and it will retract the slide body 32 into the housing 30. From the latch locking position D shown in FIG. 6, the arm 72 of the follower 74 cannot climb over the shoulder 102 onto the higher ramp 88; and it slides upwardly along the ramp 86 until it drops over the step 98 or position E. The biasing action of the spring 80 on the slide body 34 causes the slide body 32 to move outwardly of the housing 30 and the arm 72 drops onto the steps 100 and slides into the notch 84 as seen in position F of FIG. 6. The follower arm 72 is now in its second stable position.

Thus, it can be seen that the arm 72 of the follower 74 moves in an arcuate motion with respect to the axis movement of the slide body 34 and it follows a patch determined by the height of the camming surfaces within the camming recess 70.

Figure 6:
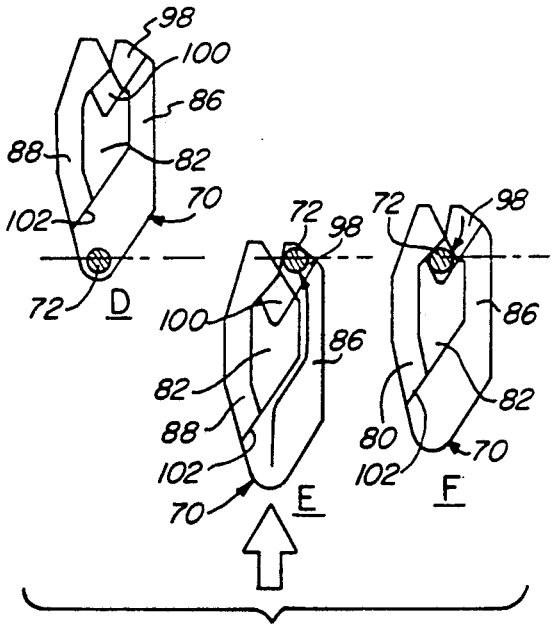

Thus, positions A, B and C of FIG. 5 show the relative motion of the parts for locking the oven door in a self-cleaning oven cycle while FIG. 6 shows an opening sequence after the self-cleaning cycle has been completed and the oven temperature has fallen to a value which will permit opening of the oven door. Similarly, FIGS. D–F of FIG. 6 show the relative motion when the latch bolt 28 is in a locked condition and the solenoid S is pulsed.

At this time, the device will be in the position shown in FIG. 8. The user may now exert a small inward force on the door 16, and the spring arm 56 will pivot the latching bolt 28 to the position shown in FIG. 9 to permit the door 15 to be opened.

Figure 12:
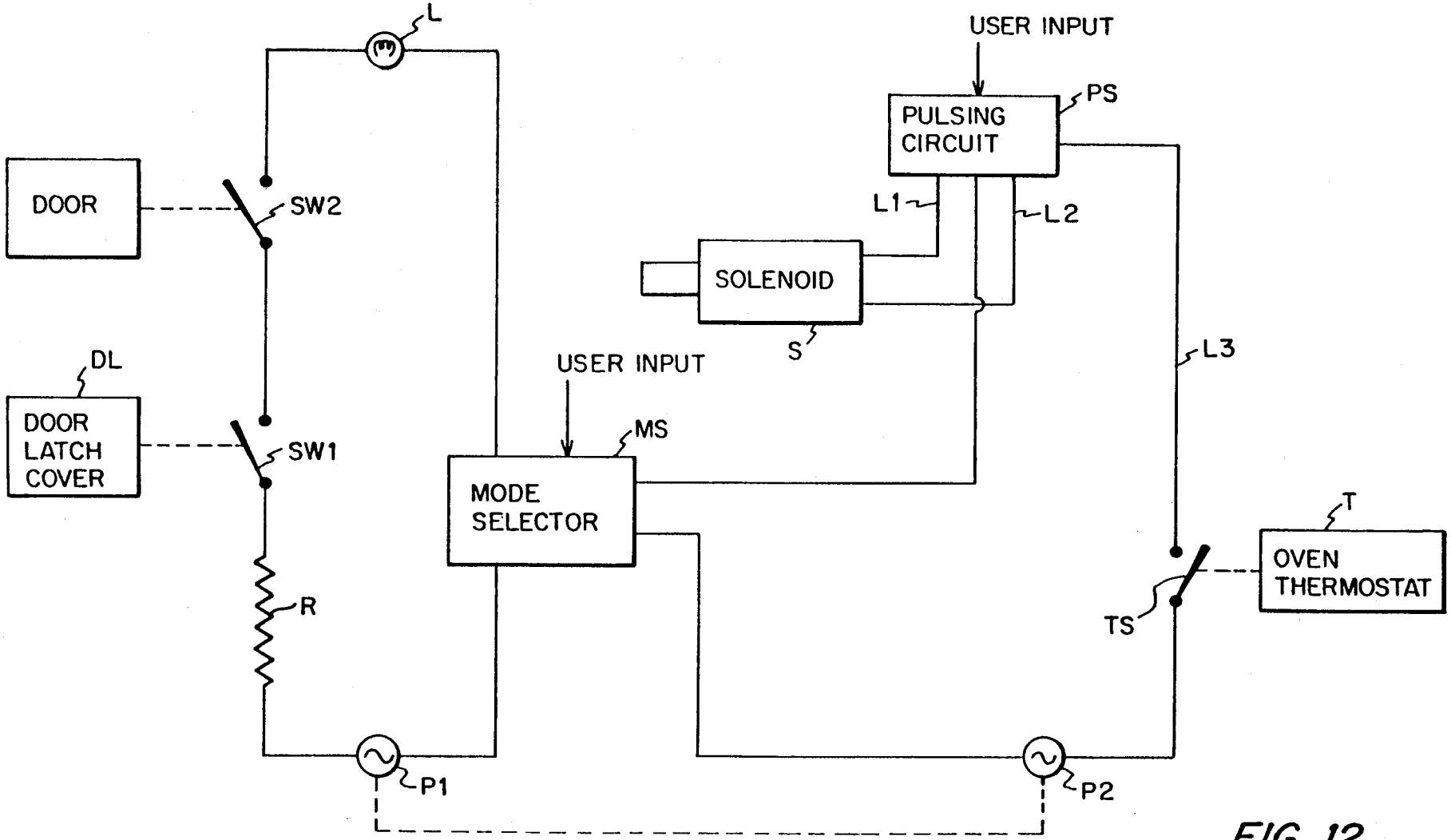
FIG. 12 is a schematic diagram of the circuit components in the latching assembly of the present invention.

Turning now to FIG. 12, therein illustrated is a circuit utilized in conjunction with the latch of the present invention. A solenoid S is connected to a pulsing circuit PS across lines L1 and L2. The solenoid S is of the type which is actuated by a pulse from pulsing circuit PS which may be a switch on the oven, set by an operator or user. The pulsing circuit PS is connected to an AC source P2. A thermostatic switch TS is positioned in line L3 and is opened by a thermostat T when the oven is at high temperature to prevent operation of pulsing circuit PS and pulsing of solenoid S when the temperature in the oven is above a predetermined value. When switch TS is open, pulsing circuit PS is disabled.

A switch SW1 senses the condition of the latch bolt LB hereinafter identified as latch bolt 28 and a switch SW2 senses whether the oven door 16 is closed.

A light L may be provided to indicate the oven is in a self-cleaning mode. The reference R indicates resistance heating elements utilized for an oven self-cleaning cycle. An oven mode selection control MS (18 in FIG. 10) permits the user to select various modes of operation for the oven including self-cleaning, bake and broil.

Both of switches SW1 and SW2 must be closed to initiate a self-cleaning cycle. Thermostat T will open switch TS when the oven temperature reaches a predetermined value, and disable any attempt to unlatch the door during a self-cleaning cycle.

FIG. 10 is a simplified diagram set forth to show schematically the latching and unlatching control of the oven door latching mechanism for a self-cleaning cycle of operation in relation to the latch assembly hereinbefore described. Various oven manufacturers will provide electrical circuitry of their own design.

The switches, SW1 and SW2 are now shown in the latch assembly figures but are conveniently microswitches on the base plate 22 and oven frame 12 to sense the position of the latch bolt and door.

In user operation of a stove embodying the invention, to initiate a self-cleaning cycle of the operation, the user first operates a switch to pulse solenoid S through pulsing circuit PS. This may be done whether or not the oven door is closed. The user must also set mode selector MS for a self-cleaning mode of operation. However, the high temperature self-cleaning mode can not begin until the door is closed to the position shown in FIG. 7. At any time until thermostatically controlled switch TS opens, the user may again pulse solenoid S to unlatch the door, and the parts will be in the condition shown in FIG. 8. At this time, the user merely pushes in on the oven door and the spring 56 will rotate the latch bolt 28 to the position shown in FIG. 9, which permits the door to be opened. However, if the oven temperature has exceeded a predetermined value, for example 600° F., then switch TS is opened and pulsing circuit PS is disabled and solenoid S cannot be energized. Therefore, the user has to wait until the self-cleaning cycle has been completed and the oven temperature has fallen to a value at which thermostat T will close switch TS.

The latch of the present invention is adapted to automatically latch the door of a self-cleaning oven. It permits a door latching cycle to be initiated while the oven door is either open or closed. However, a self-cleaning cycle of operation cannot be initiated until the door is closed in a latched position. The invention does not require use of external latching levers, but is operated merely by pushing the door to close with proper input commands to initiate a self-cleaning cycle and pushing to open when the oven temperature falls below a predetermined value after a self-cleaning cycle.

Figure 11:
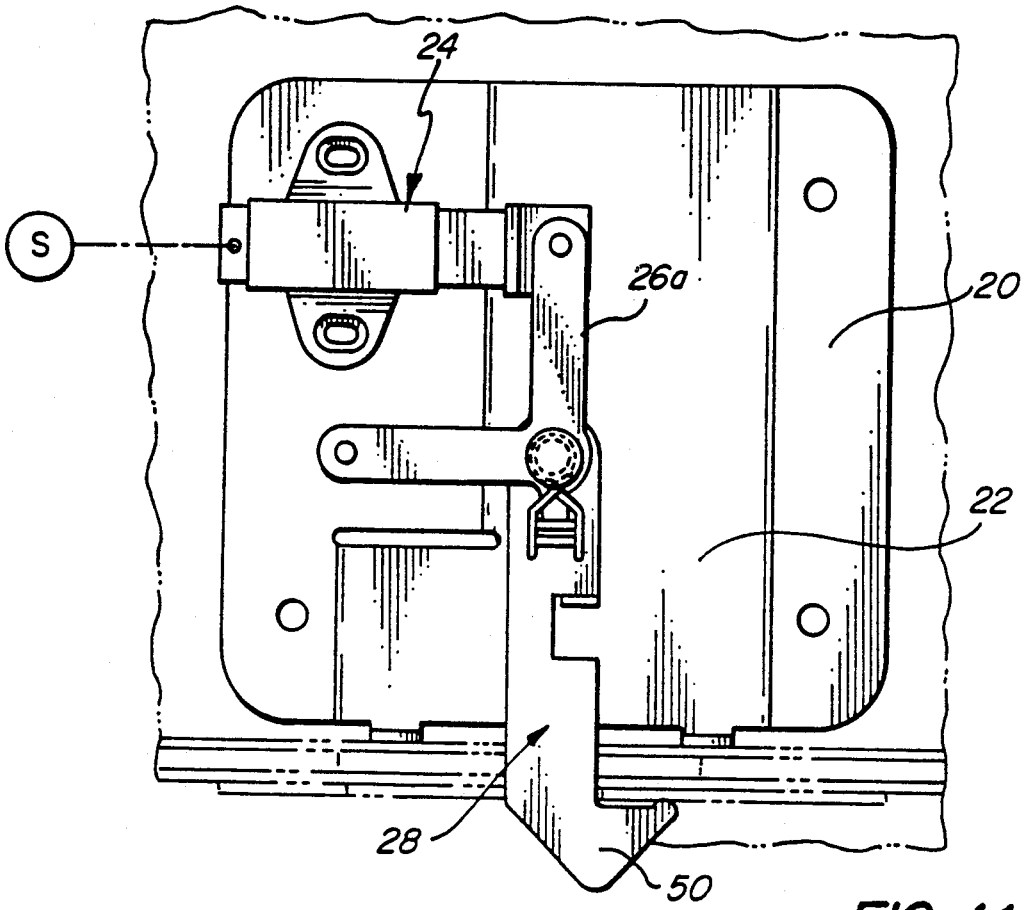
FIG. 11 is a plan view of another embodiment of the latch of the present invention.

Turning now to FIG. 11, therein illustrated is another embodiment of the present invention in which the lever **26*a* is of generally L-shaped configuration. This lever allows the positioning device 24 to be rotated 90° from the position shown in FIG. 1 to enable an alternate mounting when the space available inwardly of the oven frame is less than that required for the installation shown in FIG. 1**.

Although the positioning device which has been illustrated and described in detail hereinbefore represents a preferred embodiment, and is claimed in the aforementioned copending application, it will be appreciated that the assembly may utilize other positioning devices providing a positioning element movable between two stable positions. Similarly, although a solenoid represents a preferred actuating element to effect such movement, other devices responsive to the switching action may also be employed.

Thus, it can be seen from the foregoing detailed description and attached drawings that the latch assembly of the present invention may be fabricated and assembled relatively easily from parts which are relatively economical and long lived. The solenoid actuated positioning elements serve to enable or disable pivotal action of the latch bolt to permit opening and closing of the oven door. In the latched position, the positioning element precludes pivoting of the latch bolt into a door opening position, and the solenoid is easily disabled by a thermostatically controlled switch. No exterior operating lever is required, and the door may be opened and closed by simply pushing the door against the latch bolt to effect its pivoting.

Having thus described the invention, what is claimed is:

1. In an oven door latching system for use with a stove having an oven door, a latch assembly including;

(a) a base member adapted to be mounted on the stove adjacent the oven opening;

(b) a latch bolt having its one end pivotally mounted on a pivot pin on said base member and having a latch arm at the other end engageable with the associated oven door;

(c) a positioning device mounted on said base member having a reciprocatable element movable between first and second stable positions;

(d) a lever having one end pivotally coupled to said reciprocatable element of said positioning device, said lever being pivotally mounted on said pivot pin at a point spaced from its said one end;

(e) means connecting said latch bolt and said lever adjacent said pivot pin whereby, when said positioning device is actuated to move said reciprocatable element between said first and second stable positions, pivotal motion is imparted to said lever and said connecting means enables pivotal motion of said latch bolt; and (f) actuatable means for acting on said positioning device to move said lever to enable movement of said bolt between an oven door latching position and an oven door unlatching position.

2. The oven door latching system in accordance with claim 1 wherein said connecting means includes resiliently deformable means to bias said latch bolt into its two positions.

3. The oven door latching system in accordance with claim 2 wherein said latch bolt and lever have projecting portions thereon which are spaced apart and said resiliently deformable means comprises a spring engaged with said projecting portions.

4. The oven door latching system in accordance with claim 1 wherein said actuatable means is a solenoid actuated by setting of the associated oven into a self-cleaning condition.

5. In an oven door latching system for use with a stove having an oven door with a keeper, a latch assembly including:

(a) a base member adapted to be mounted on the stove adjacent the oven opening;

(b) a latch bold having its one end pivotally mounted on a pivot arm on said base member and having a latch arm at the other end engageable with the associated oven door;

(c) a positioning device mounted on said base member and having a reciprocatable element therein movable between first and second stable positions;

(d) a lever having one end pivotally coupled to said positioning device, said lever being pivotally mounted on said pivot pin at a point spaced from its said one end;

(e) means connecting said latch bolt and said lever adjacent said pivot pin whereby , when said positioning device is actuated to move said element in the direction of said latch arm from said first position to said second position, pivotal motion is imparted to said lever and said connecting means enables pivotal motion of said latch bolt, said connecting means including resiliently deformable means to bias said latch bolt into its two positions; and (f) a solenoid acting on said positioning device for moving said reciprocatable element between said first and second positions, displacement of said reciprocatable element between its said stable positions producing concurrent motion of said lever to enable movement of said bolt between an over door latching position and an oven door unlatching position.

6. The oven door latching system in accordance with claim 5 wherein said latch bolt and lever having projecting portions thereon which are spaced apart and wherein said resiliently deformable means comprises a spring engaged with said projecting portions to bias said latch bolt.

7. A stove having;

(a) a frame defining an oven chamber and an opening thereinto;

(b) a door having one edge pivotably mounted on said frame at one side of said chamber opening for movement between a closed position sealing said oven chamber and an open position;

(c) a latching lever assembly including (i) a base member mounted on said frame at the side opposite that on which said door is pivotably mounted, (i) a latch bolt having its one end pivotally mounted on a pivot pin on said base member and having a latch arm at the other end extending outwardly of said frame and engageable with said oven door, (iii) a positioning device mounted on said base member having a reciprocatable movable element movable between first and second stable positions, (iv) a lever having one end pivotally coupled said reciprocatable element said lever being pivotally mounted on said pivot pin at a point spaced from its said one end, (v) means connecting said latch bolt and said lever adjacent said pivot pin whereby, when said positioning device is actuated to move said reciprocatable element from said first to said second position, pivotal motion is imparted to said lever and said connecting means enables pivotal motion of said latch bolt; and (vi) actuatable means for acting on said positioning device to move said lever to enable movement of said bolt between a latching position in which said bolt is engaged with said keeper in said door and an oven door unlatching position.

8. The stove in accordance with claim 7 wherein said connecting means include resiliently deformable means to bias said latch bolt into its two positions.

9. The stove in accordance with claim 8 wherein said latch bolt and lever have projecting portions thereon which are spaced apart and said resiliently deformable means comprises a spring engaged with said projecting portions.

10. The stove in accordance with claim 7 wherein said actuatable means is a solenoid actuated by setting of the associated oven into a self-cleaning condition.

11. The stove in accordance with claim 7 wherein said stove has a switch movable into a position to actuate a self-cleaning cycle and actuation of said switch moves said movable element and thereby said latch bolt into a door latching position.

* * * * *